US007163569B2

(12) United States Patent
Toyoshima et al.

(10) Patent No.: US 7,163,569 B2
(45) Date of Patent: Jan. 16, 2007

(54) RAW OR GRANULATED POWDER FOR SINTERING, AND THEIR SINTERED COMPACTS

(75) Inventors: Hisataka Toyoshima, Aomori-ken (JP); Atsushi Watanabe, Aomori-ken (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 10/789,937

(22) Filed: Feb. 27, 2004

(65) Prior Publication Data

US 2005/0109157 A1 May 26, 2005

(30) Foreign Application Priority Data

Nov. 26, 2003 (JP) ..... 2003-396182

(51) Int. Cl.
*B22F 1/00* (2006.01)
*B22F 3/12* (2006.01)

(52) U.S. Cl. ..... 75/252; 75/255; 75/243; 75/246; 419/36; 419/38

(58) Field of Classification Search ..... 75/252, 75/255, 243, 246; 419/1, 36, 38
See application file for complete search history.

(56) References Cited

U.S. PATENT DOCUMENTS 2,430,671 A * 11/1947 Feild ..... 75/567
3,460,940 A * 8/1969 Talmage ..... 419/19
5,006,164 A * 4/1991 Kiyota ..... 75/255
5,069,867 A * 12/1991 Zengin ..... 419/15
5,338,508 A * 8/1994 Nitta et al. ..... 420/120
5,766,304 A * 6/1998 Uenosono et al. ..... 75/252

FOREIGN PATENT DOCUMENTS

| | | |
|---|---|---|
| GB | 1009425 | 11/1965 |
| JP | 06-057301 | 3/1994 |
| JP | 11-302787 | 11/1999 |
| KR | 2000-0042176 | 7/2000 |

OTHER PUBLICATIONS

Salak, A., "Ferrous Powder Metallurgy", Cambridge Int. SC. Publ., 1995, pp. 46-47; 118-123; 174-176.
Patent Abstracts of Japan re: publication number 60208456.
Communication from European Patent Office re: counterpart application.
Communication from Korean Patent Office re: related application.
Zhan et al., Powder injection molding process & appliction:, Oct. 2003, pp. 55-57, China and its English translation of the relevant part.
Communication from Chinese Patent Office re: related application.

* cited by examiner

*Primary Examiner*—Ngoclan T. Mai
(74) *Attorney, Agent, or Firm*—Harness, Dickey & Pierce, P.L.C.

(57) ABSTRACT

An object of the present invention is to provide a low-alloyed steel powder for sintering that can yield a sintered compact with high density and uniform characteristics, and to provide a sintered compact having such characteristics. The present invention is a raw powder for sintering, comprising Fe as its primary component and also comprising 0.8 wt % or less of C, 0.05 to 1.0 wt % of Si, 1.0 wt % or less of Mn, and 1.0 to 10.0 wt % or less of Ni, wherein the mean grain size of the raw powder for sintering is 8.5 μm or less; and is also a granulated powder for sintering obtained by granulating the raw powder for sintering by means of a binder.

8 Claims, 1 Drawing Sheet

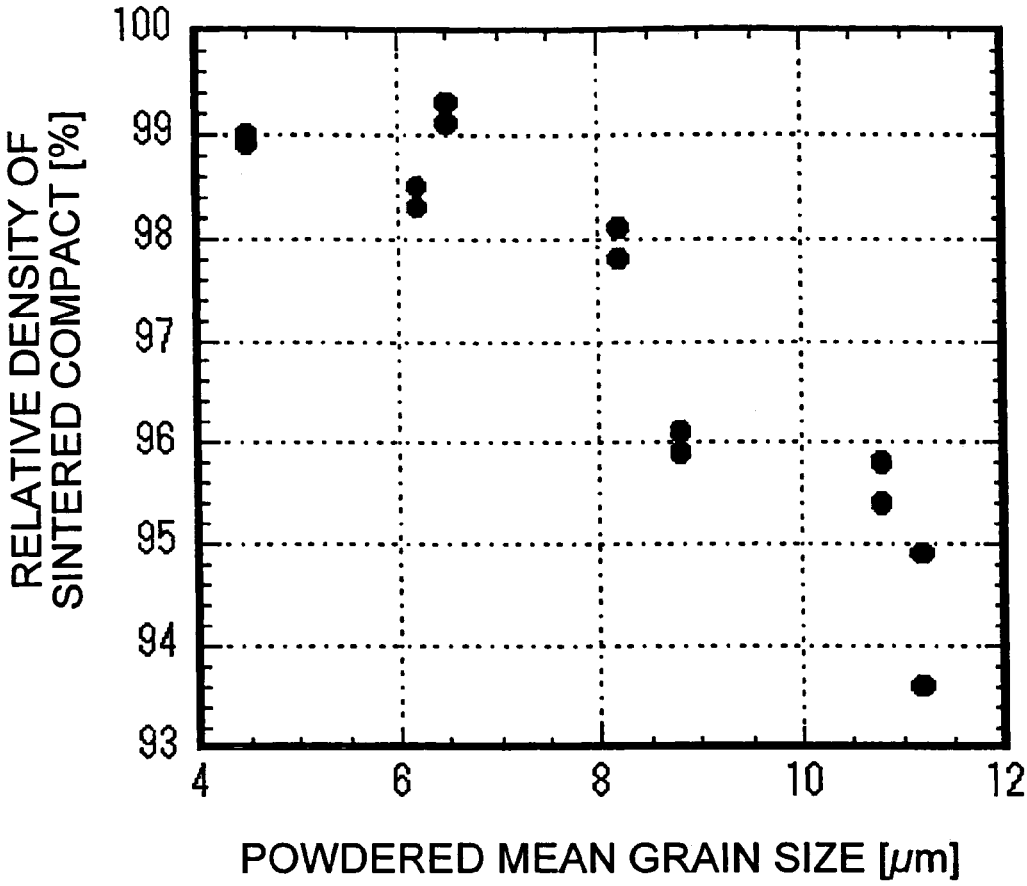
FIG. 1 RELATIONSHIP BETWEEN POWDERED MEAN GRAIN SIZE AND RELATIVE DENSITY

RAW OR GRANULATED POWDER FOR SINTERING, AND THEIR SINTERED COMPACTS

BACKGROUND

The present invention relates to a raw powder for sintering, and also relates to a microparticulate low-alloyed steel for sintering or other such raw powder for sintering that has a high sintered density and has been modified to obtain uniform characteristics, or a granulated powder for sintering obtained by granulating the raw powder for sintering, and to a sintered compact obtained using the raw powder for sintering or the granulated powder for sintering.

When sintered articles are manufactured, the properties required of the sintered products include high density, dimensional precision, and characteristics such as tensile strength, hardness, fatigue strength, impact strength, abrasion resistance, and other such characteristics, as well as uniformity, but it is not easy to simultaneously achieve the desired density, dimensional precision, and other characteristics.

Typical known methods for obtaining a conventional sintered compact of low-alloyed steel include premix methods and prealloy methods.

A premix method is a method of uniformly mixing iron powder and metal powder or alloy powder, molding the resulting mixture, and then heating and sintering the mixture to obtain a solid solution from the added elements. This method has difficulties in that the added metal powder or alloy powder mixed into the iron powder separates or segregates due to differences in relative density in the steps up to molding, or that the diffusion of added elements during sintering is inadequate and does not progress uniformly, and problems with product quality occur in that there are fluctuations in the strength or dimensions of the sintered compact due to the nonuniformity of the sintered compact.

Metal injection molding is known as a method of obtaining a sintered compact with a high sintered density and uniform properties in the molding step. In this method, a mixture of carbonyl iron powder, carbonyl nickel powder, or another such carbonyl metal powder with a small powder grain size is commonly used. However, these carbonyl metal powders are manufactured by thermal decomposition of a metal carbonyl, and such manufacture requires high energy and is expensive, and also the metal carbonyl itself is poisonous and has therefore been the cause of environmental problems. Also, carbonyl nickel powder has poses health problems when absorbed into the body. Furthermore, because of the aspects of carbonyl powder, there have also been problems of low molding density and poor dimensional precision compared with atomized powder.

A prealloy method is a method of using a powder manufactured by atomization or the like from alloyed steel wherein Ni, Cu, Mo, or other such necessary alloying elements have been dissolved in iron in advance. Since the necessary alloying elements are dissolved in iron in advance, this method is free of problems such as those encountered in the premix method and metal injection molding method.

As an example of obtaining raw powder for sintering or a sintered compact by prealloy methods, Japanese Patent Application Laid-open No. H6-57301 discloses the concept of prealloying Cr and Mo and alloying Ni or Cu by composite alloying to obtain a raw powder for sintering that combines high dimensional precision, high strength, and high fatigue properties, that has little dimensional variation and strength fluctuation, and that is suitable for manufacturing sintered articles.

Also, Japanese Patent Application Laid-open No. H11-302787 discloses that high-strength sintered articles can be manufactured from water-atomized iron powder comprising 1.0 to 10.0 wt % of Cu as a prealloying element, with Fe and unavoidable impurities constituting the balance.

However, with these prealloyed conventional atomized powders, the primary phase of the metal structure is the austenite phase at a temperature of 1200° C. or greater, which is the sintering temperature. Therefore the diffusion rate is low, which causes problems in that sintering is reduced and the sintered density cannot be increased, as well as problems in that the crystal grains tend to become coarser, making it difficult to obtain a sintered compact with stable characteristics.

Furthermore, regarding the effect of the grain size of the powder, there have also been problems with the post-sintering depth of carburized hardening becoming unstable because of low sintered density and a large number of closed pores when the powder has a large mean grain size.

Yet another problem is that although the sintering may be satisfactory and the sintered density may be improved, the fluidity is still inferior. Therefore, problems have been encountered in the sense that poor moldability is achieved with compression molding methods, and, in particular, that uniform filling is difficult to achieve in the case of products with complicated shapes.

Also, since the molding density is low, dimensional precision of the sintered compact has been poor and there have been limits on the grain size that can be used. Therefore, there have also been limits on the sintered density of the resulting sintered compact.

Furthermore, sintered compacts with low sintered densities have had problems in that strength, toughness, and other such characteristics are poor and vary widely, the product surface has low glossiness and a poor appearance, and product quality is compromised, so there have been restrictions on the applicable range of grain sizes for the raw powder for sintering.

There are also examples of increasing the strength of a sintered compact without increasing its density (for example, Japanese Patent Application Laid-open No. H6-65693), but even in such cases it is vital to increase the density of the sintered compact in order to obtain strength equal to that of products obtained by melting.

The present invention was achieved in view of circumstances such as those described above, and an object thereof is to provide raw powder for sintering or granulated powder for sintering whereby a sintered compact with a high sintered density can be obtained at a low manufacturing cost.

Another object is to provide raw powder for sintering or granulated powder for sintering whereby a sintered compact having stable characteristics and a satisfactory post-sintering depth of carburized hardening can be obtained.

SUMMARY

The inventors have solved the above-mentioned problems as a result of studies on various component systems and sintering conditions, and the present invention is intended to provide a raw powder for sintering in which Fe is the primary component and which also comprises 0.8 wt % or less of C, 0.05 to 1.0 wt % of Si, 1.0 wt % or less of Mn, and 10.0 wt % or less of Ni, wherein the mean grain size of the raw powder for sintering is 8.5 μm or less. Since the mean grain size of the raw powder for sintering is comparatively small as described above, the sintering diffusion rate is improved and the quality of sintering is markedly enhanced. The raw powder for sintering does not require any special pretreatment, and a homogenous sintered compact with high density and a high degree of strength can be obtained.

Also, the present invention is intended to provide granulated powder for sintering obtained by granulating the raw powder for sintering by means of a binder.

Furthermore, the present invention is intended to provide a sintered compact with a relative density of 97% or greater, manufactured using the raw powder for sintering or the granulated powder for sintering.

Furthermore, the present invention is intended to provide a method for manufacturing a sintered compact, comprising a step in which the raw powder for sintering or the granulated powder for sintering is first molded and then sintered under specific temperature conditions.

DESCRIPTION OF DRAWINGS

FIG. 1 is a diagram showing the relationship between the mean grain size of low-alloyed steel powder for metal injection molding (MIM) and sintering and the MIM sintered density.

DETAILED DESCRIPTION (Embodiment 1) Raw Powder for Sintering

The raw powder for sintering relating to Embodiment 1 has Fe as its primary component and comprises 0.8 wt % or less of C, 0.05 to 1.0 wt % of Si, 1.0 wt % or less of Mn, and 1.0 to 10.0 wt % or less of Ni.

C is a strength-enhancing element, and 0.8 wt % or less is included in light of the fact that it reacts during sintering, and the oxygen and oxides in the powder are removed as CO gas. In the case of compression molding it is preferable that the content be as low as possible because of considerations related to compressibility. When the content exceeds 0.8 wt %, the raw powder for sintering hardens and compressibility during compression molding is poor. It may also be a mixture of C powder (graphite powder or the like) in the above-mentioned amount with prealloy powder that either does not contain or only partially contains C, and such conditions are also included in the present embodiment.

Si is a necessary element for deoxidation during steel manufacturing and is also an element beneficial for increasing the strength of sintered products, and 0.05 to 1.0 wt % is included in light of the compressibility of the raw powder for sintering.

Mn is a necessary element for deoxidation during steel manufacturing in the same manner as Si and is also effective for increasing hardening, and 1.0 wt % or less is included based on the fact that a large amount of the element increases the oxygen content of the atomized powder and hinders sintering, and less is better in view of the compressibility of the raw powder for sintering.

Ni is a beneficial element for increasing strength and toughness. 1.0 to 10.0 wt % is added because at 1.0 wt % or less, strength and toughness are low, which is impractical, and at more than 10.0 wt % it becomes expensive.

Next, the elements to be added as needed will be described. The above-mentioned raw powder for sintering can further contain at least one element selected from among 2.0 wt % or less of Cr, 3.0 wt % or less of Mo, 3.0 wt % or less of Cu, 0.15 to 1.0 wt % of Nb, and 0.05 wt % or less of Ti.

Cr is an element that increases hardening and contributes to the improvement of sintered compact strength and is included as needed, but the upper limit is 2.0 wt % because at 2.0 wt % the effect of this element is substantially saturated and the manufacturing costs are high.

Nb is an element that has a high cohesive strength with carbon and nitrogen, produces Nb carbonitrides, and is effective for improving the miniaturization and strength of crystals. The smaller the crystal grain size, the easier it is for the holes present in the crystal grains to move to the grains boundary and disappear during sintering, whereby the sintered density is improved.

Conventionally, the main phase of a low-alloyed steel structure at the sintering temperature is the austenite phase, but the diffusion rate of the element is low and the crystal grains tend to become coarser, which has caused problems of poor sintering and the inability to increase the sintered density. The present embodiment has the effect of distributing and precipitating fine Nb carbonitrides as well as preventing the crystal grains from becoming coarser by adding an appropriate amount of Nb, and adding Nb is highly effective for obtaining a sintered compact of higher density.

Thermodynamically, the precipitation of Nb carbonitrides decreases at higher temperatures, so the added amount of Nb for obtaining said effects at a sintering temperature of 1200° C. or greater is preferably 0.15 wt % or greater. At less than 0.15 wt % the above-mentioned effects are not sufficiently displayed. The upper limit is 1.0 wt % because when the content of Nb is high costs increase, the effects are saturated even if 1.0 wt % or more is added, coarse Nb compounds are produced, and the physical properties of the sintered compact are adversely affected.

Mo is added as needed because it is an element that increases hardening, prevents softening during hardening and tempering, and improves corrosion resistance. 3.0 wt % or less is added because manufacturing costs increase and the effects are saturated when the added amount is high.

Cu is an element that improves corrosion resistance in the same manner as Mo, and is added as needed. 3.0 wt % or less is added because manufacturing costs increase and the effects are saturated when the added amount is high.

Similarly to Nb, Ti is a carbonitride-forming element, and is added as needed to precipitate fine carbonitrides and to improve both sintered density and strength. However, the upper limit is 0.05 wt % because when the Ti content is high, not only are the effects saturated, but problems arise in that the orifice of the melt nozzle is negatively affected during atomization and the nozzle is sometimes blocked off, or problems arise in that powder oxygen may increase while sintering is reduced.

The mean grain size of these raw powders for sintering is 8.5 μm or less, and preferably 8 μm or less. When the mean grain size exceeds 8.5 μm, a sintered compact with a sintered density of 97% or greater cannot be obtained, and stable characteristics of the sintered compact cannot be obtained because many closed pores remain in the sintered compact.

At a smaller mean grain size, sintered density increases and the sintering temperature can be lowered. It is also possible to prevent the crystals of the sintered compact from becoming coarse, and the characteristics of the sintered compact can be more highly stabilized.

Possible examples of the binder used in the present embodiment include polyvinyl alcohol (PVA), polyvinyl pyrrolidone (PVP), stearic acid, paraffin, wax, alginic acid soda, agar, gum arabic, resins, sucrose, and the like. One of such binders may be used alone or a combination of two or more may also be used. Of these binders, polyvinyl alcohol or polyvinyl pyrrolidone is preferred because of its high bonding strength, improved removal by heating, and low cost.

The binder that can be used in the present embodiment is not limited to the examples given above, and one suitably selected from among known binders according to the degree of saponification or polymerization can be used as long as it can function as a binding agent.

The amount in which the binder is admixed varies with the molding method, the amount of alloyed steel powder used, and the like, and is suitably adjusted in accordance with such factors. Therefore, the amount in which the binder is admixed is not particularly limited as long as the effects of the present invention are achieved.

The method for manufacturing the raw powder for sintering can involve dissolving the alloying elements in iron in advance by prealloy methods, and using the resulting molten metal to manufacture the raw powder by water atomization, gas atomization, combined gas atomization and water atomization, or other such known manufacturing methods.

Also, the amount in which the binder being used is admixed into a solution (hereinafter also referred to as "binder solution") obtained by dissolving the binder in a solvent is not particularly limited and can be appropriately determined depending on the grain shape or grain size distribution of the alloyed steel powder. For example, 0.5 to 10 wt % thereof, preferably 1 to 5 wt %, may be blended per 100 wt % of water.

The raw powder for sintering of the present embodiment can be suitably used in compression molding and metal injection molding (MIM).

(Embodiment 2) Granulated Powder for Sintering

The granulated powder for sintering of the present embodiment is formed by granulating the raw powder for sintering described in Embodiment 1 by means of a binder.

The granulated powder for sintering of the present embodiment is preferably formed using a binder solution.

The same binder as the one described with reference to Embodiment 1 can be used as the binder for granulation.

Possible examples of the solvent used in the binder solution include water, alcohols such as methyl alcohol and ethyl alcohol, and other such solvents. One of these solvents may be used alone, or a combination of two or more may also be used.

In the granulated powder for compression mold sintering, fluidity and moldability can be improved to achieve a high filling rate, but the mean grain size is preferably 10 to 150 μm in regards to obtaining a sintered compact with satisfactory dimensional precision and material characteristics after sintering.

The granulated powder for sintering of the present embodiment can be suitably used in compression molding and metal injection molding (MIM).

(Embodiment 3) Method for Manufacturing Sintered Compact

The method for manufacturing the sintered compact of the present embodiment comprises a first step of manufacturing raw material for sintering (the raw powder for sintering of Embodiment 1 or the granulated powder for sintering of Embodiment 2), and a second step of molding the raw material for sintering obtained in the first step, and sintering the molded material.

The method for manufacturing a raw material for sintering, which is the first step, is as previously described and is therefore not described here. Graphite powder can also be added as needed.

The second step preferably comprises at least a step of sintering the material in temperature conditions of 1200 to 1400° C., and preferably 1250 to 1380° C.

Sintering under the above-mentioned temperature conditions makes it possible to obtain products with high density and a good mirror finish. The pressure conditions in the aforementioned atmosphere can be set in a timely manner by increasing or decreasing pressure, but a vacuum atmosphere is preferred. Oxidation of the molded article or sintered compact can be prevented by conducting sintering under such conditions.

A step for performing a degreasing treatment in advance may be included after molding the granulated powder obtained in the first step and prior to sintering. Particularly, since metal injection molding normally calls for the use of more of the binder than does compression molding, a degreasing treatment is preferable. If the binder remains in large amounts in the ultimately obtained sintered compact, then, for example, swelling, cracking, and other such problems occur and the binder components may remain in the sintered compact and adversely affect the properties of the resulting sintered compact. Particularly, when carbon originating in the binder or the like remains, caution must be taken because corrosion resistance is significantly reduced.

The methods and conditions for molding and degreasing treatment are not particularly limited, but in the case of compression molding, for example, 0.5 to 1.5 wt % of zinc stearate, Acrawax, or another such lubricant is commonly added and mixed with the entire raw material for the purpose of reducing friction within the raw powder and friction between the powder and the metal mold and improving compressibility, the powder is then packed into a die, and the material is compressed with top and bottom punches at a pressure of 2 to 8 t/cm$^2$ and molded into a specific shape. Next, the molded article is degreased by being heated to 500 to 700 degrees for 0.5 to 2 hours in an atmosphere of hydrogen or ammonia.

In the case of metal injection molding, first, for example, 2 to 20 parts by weight, or preferably 5 to 15 parts by weight, of polyethylene or another such thermoplastic polymer resin, carnauba wax or another such binder, and a surfactant or the like as needed are blended per 100 parts by weight of the raw powder, and the resulting blend is kneaded at 150 to 180 degrees for 0.5 to 1 hour. Next, the kneaded mixture is broken into pellets by means of a crusher. Next a pressure of 500 to 1500 kgf/cm$^2$ is applied in an injection molding machine, and the pellets are forced into a metal mold. The molded article is then degreased by being heated to 500 to 700 degrees for 0.5 to 2 hours in an atmosphere of hydrogen or ammonia. The relative density of the resulting sintered compact is 97% or greater, preferably 98% or greater, and more preferably 99% or greater. A relative density in the above-mentioned range results in a good mirror finish and makes it possible to obtain products with excellent corrosion resistance and mechanical strength.

EXAMPLE 1

A composition of alloying elements comprising 0.48 wt % of C, 0.12 wt % of Si, 0.31 wt % of Mn, 2.1 wt % of Ni, and 0.31 wt % of Nb, with iron and unavoidable impurities constituting the balance, was blended and dissolved, and microparticulate low-alloyed steel for sintering with a mean grain size of 8.2 μm was manufactured from the resulting melt by water atomization. A binder was added and mixed with this microparticulate low-alloyed steel for sintering, the mixture was injection molded in a metal mold, the binder was removed, and the mixture was sintered in a sintering furnace with a vacuum atmosphere at 1300° C. for 2 hours to obtain a sintered compact.

The mean grain size of the microparticulate low-alloyed steel for sintering was measured with a commercially available laser-diffraction particle size analyzer (made by Nikkiso Co., Ltd., name of device: SRA7995).

EXAMPLE 2

Granulation was performed in the following manner using microparticulate low-alloyed steel for sintering with the same composition used in Example 1 as raw powder. Specifically, the raw powder was introduced into a rolling fluidization granulator (made by Powrex Corporation, name of device: Multiplex Granulator MP01) and granulated while a binder for granulation was continuously fed to the granulator to obtain granulated powder with a mean grain size of 35 μm. The binder used for granulation contained 1 wt % of a 5-wt % solution of polyvinyl alcohol (hereinafter referred to as PVA) in methyl alcohol as the solvent, expressed as the effective PVA amount.

Next, 1 wt % of Acrawax (made by Lonza Group Ltd.) was added as a lubricant to the granulated powder, a press was used at a molding pressure of 5 t/cm$^2$ to mold a disc-shaped specimen with a diameter of 30 mm and a thickness of 5 mm (hereinafter also referred to simply as "disc-shaped specimen"), and sintered metal material tensile specimens (occasionally referred to hereinbelow as "tensile specimens") stipulated in Standard JPMA M04-1992 of Japan Powder Metallurgy Association were molded.

These specimens were degreased in an atmosphere of ammonia decomposition gas at 400° C. and were then sintered in a sintering furnace with a vacuum atmosphere at 1300° C. for 2 hours to obtain a sintered compact.

EXAMPLE 3

The desired sintered compact was obtained by the same method as in Example 1, except that the composition of microparticulate low-alloyed steel for sintering comprised 0.42 wt % of C, 0.15 wt % of Si, 0.23 wt % of Mn, and 2.0 wt % of Ni, and the mean grain size of the microparticulate low-alloyed steel for sintering was 4.5 μm.

EXAMPLE 4

The desired sintered compact was obtained by the same method as in Example 2, except that granulation was performed using microparticulate low-alloyed steel for sintering with the same composition as in Example 3 as raw powder, and the granulated powder had a mean grain size of 40 μm.

EXAMPLE 5

The desired sintered compact was obtained by the same method as in Example 1, except that the composition of microparticulate low-alloyed steel for sintering comprised 0.32 wt % of C, 0.25 wt % of Si, 0.23 wt % of Mn, 2.0 wt % of Ni, 0.5 wt % of Cr, 0.22 wt % of Nb, 0.5 wt % of Mo, 0.23 wt % of Cu, and 0.02 wt % of Ti, and the mean grain size of the microparticulate low-alloyed steel for sintering was 6.5 μm.

EXAMPLE 6

The desired sintered compact was obtained by the same method as in Example 2, except that granulation was performed using microparticulate low-alloyed steel for sintering with the same composition as in Example 5 as raw powder, and the granulated powder had a mean grain size of 48 μm.

EXAMPLE 7

The desired sintered compact was obtained by the same method as in Example 1, except that the composition of microparticulate low-alloyed steel for sintering comprised 0.30 wt % of C, 0.20 wt % of Si, 0.12 wt % of Mn, 8.0 wt % of Ni, and 0.82 wt % of Nb, and the mean grain size of the microparticulate low-alloyed steel for sintering was 6.2 μm.

EXAMPLE 8

The desired sintered compact was obtained by the same method as in Example 2, except that granulation was performed using microparticulate low-alloyed steel for sintering with the same composition as in Example 7 as raw powder, and the granulated powder had a mean grain size of 45 μm.

COMPARATIVE EXAMPLES

Comparative Examples 1 through 6 involved manufacturing sintered compacts with the compositions, powdered mean grain size, and granulated mean grain size according to Table 1.

Test Case 1—Measuring Relative Density

Relative densities were measured using the sintered compacts (disc-shaped specimens) obtained in Examples 2, 4, 6, and 8 as test specimens. First, the sintered compact densities were measured in accordance with Standard JPMA M01-1992 of Japan Powder Metallurgy Association, "Sintered Metal Materials: Method for Testing Density, Oil Content, and Free Porosity," and the relative densities were calculated as percentages based on the difference between the sintered densities and the true densities.

The results are shown in Table 1. The compositions, powdered mean grain sizes (μm), and granulated mean grain sizes (μm) are also shown. FIG. 1 shows the relationship between the mean grain size of a low-alloyed steel powder for metal injection molding (MIM) and sintering and the MIM sintered density.

The sintered compacts of Examples 2, 4, 6, and 8 all had relative densities of 97% or greater, and it was determined that sintered compacts with high densities were obtained.

Test Case 2—Evaluating Mechanical Properties

The mechanical properties (uniformity of strength, uniformity of elongation) of the sintered compacts were evaluated using the sintered compacts (tensile specimens) obtained in Examples 2, 4, 6, and 8 as test specimens. Tensile tests were conducted with stress of 1 mm/min using an Instron universal materials tester (model 4206) as the testing method.

1. Evaluating Uniformity of Strength

The aforementioned tensile tests were conducted ten times for each specimen to calculate the tensile strength of the sintered compacts. Variations in the ten measured values in relation to the mean values were calculated as percentages, and the results were used to evaluate uniformity. The evaluation criteria were as follows.

| | |
|---|---|
| ○: | less than 10% |
| Δ: | 10% or greater to less than 15% |
| X: | 15% or greater |

2. Evaluating Uniformity of Elongation

The aforementioned tensile tests were conducted ten times for each specimen to calculate the elongation of the sintered compacts. Variations in the ten measured values in relation to the mean values were calculated as percentages, and the results were used to evaluate uniformity. The evaluation criteria were as follows.

| | |
|---|---|
| ○: | less than 10% |
| Δ: | 10% or greater to less than 15% |
| X: | 15% or greater |

Test Case 3—Evaluating Carburized Hardening

The carburized hardening of the sintered compacts was evaluated using the sintered compacts (disc-shaped specimens) obtained in Examples 2, 4, 6, and 8 as test specimens.

The testing methods involved performing hardening and tempering treatments to the desired hardness by established methods, measuring the hardness, and evaluating the results based on the difference between the desired hardness and the actual hardness. The evaluation criteria were as follows.

Rockwell hardness (HRC) in relation to the desired hardness:

| | |
|---|---|
| ○: | less than ±3 |
| Δ: | ±3 or greater, less than ±5 |
| X: | ±5 or greater |

TABLE 2

| | MECHANICAL PROPERTIES | | CSRBURIZED |
|---|---|---|---|
| | UNIFORMITY OF STRENGTH | UNIFORMITY OF ELONGATION | HSRDENING UNIFORMITY |
| EXAMPLE | | | |
| 2 | ○ | ○ | ○ |
| 4 | ○ | ○ | ○ |
| 6 | ○ | ○ | ○ |
| 8 | ○ | ○ | ○ |
| COMPARATIVE EXAMPLE | | | |
| 2 | Δ | Δ | X |
| 4 | X | X | X |
| 6 | X | X | X |

Effects of the Invention

The raw powder for sintering or granulated powder for sintering relating to the present invention makes it possible to obtain a sintered compact with low manufacturing costs, improved fluidity, moldability, and sintering properties, and high sintered density. Also, it is possible to obtain a sintered compact having stable characteristics and satisfactory post-sintering depth of carburized hardening.

This application claims priority to Japanese Patent Application No. 2003-396182 filed Nov. 26, 2003 which is hereby expressly incorporated by reference herein in its entirety.

What is claimed is:

1. A raw powder for sintering, comprising Fe as its primary component and also comprising 0.8 wt % or less of C, 0.05 to 1.0 wt % of Si, 1.0 wt % or less of Mn, 0.15 to 1.0 wt % of Nb, and 1.0 to 10.0 wt % or less of Ni, wherein the mean grain size of the raw powder for sintering is 8.5 μm or less; and further containing at least one element selected from among 2.0 wt % or less of Cr, 3.0 wt % or less of Mo, 3.0 wt % or less of Cu, and 0.05 wt % or less of Ti.

TABLE I

| | COMPOSITION (%) | | | | | | | | | | | POWDERED MEAN GRAIN SIZE | GRANULATED MEAN GRAIN SIZE | RELATIVE DENSITY (%) | |
|---|---|---|---|---|---|---|---|---|---|---|---|---|---|---|---|
| EXAMPLE | C | Si | Mn | P | S | Cr | Ni | Mo | Cu | Nb | Ti | (μm) | (μm) | METAL INJECTION MOLDING | COMPRESSION MOLDING |
| 1 | 0.48 | 0.12 | 0.31 | 0.014 | 0.004 | 0.04 | 2.10 | — | — | 0.31 | — | 8.2 | — | 97.8 | — |
| 2 | 0.48 | 0.12 | 0.31 | 0.014 | 0.004 | 0.04 | 2.10 | — | — | 0.31 | — | — | 35 | — | 98.1 |
| 3 | 0.42 | 0.15 | 0.23 | 0.015 | 0.003 | 0.04 | 2.00 | — | — | — | — | 4.5 | — | 98.9 | — |
| 4 | 0.42 | 0.15 | 0.23 | 0.015 | 0.003 | 0.04 | 2.00 | — | — | — | — | — | 40 | — | 99.0 |
| 5 | 0.32 | 0.25 | 0.23 | 0.018 | 0.005 | 0.50 | 2.00 | 0.5 | 0.23 | 0.22 | 0.02 | 6.5 | — | 99.3 | — |
| 6 | 0.32 | 0.25 | 0.23 | 0.018 | 0.005 | 0.50 | 2.00 | 0.5 | 0.23 | 0.22 | 0.02 | — | 48 | — | 99.1 |
| 7 | 0.30 | 0.20 | 0.12 | 0.012 | 0.011 | 0.02 | 8.04 | — | — | 0.82 | — | 6.2 | — | 98.3 | — |
| 8 | 0.30 | 0.20 | 0.12 | 0.012 | 0.011 | 0.02 | 8.04 | — | — | 0.82 | — | — | 45 | — | 98.5 |
| COMPARATIVE EXAMPLE | | | | | | | | | | | | | | | |
| 1 | 0.35 | 0.22 | 0.28 | 0.016 | 0.003 | 0.03 | 2.10 | — | — | — | — | 8.8 | — | 95.9 | — |
| 2 | 0.35 | 0.22 | 0.28 | 0.016 | 0.003 | 0.03 | 2.10 | — | — | — | — | — | 45 | — | 96.1 |
| 3 | 0.46 | 0.16 | 0.19 | 0.015 | 0.006 | 0.01 | 8.10 | — | — | 0.31 | — | 10.8 | — | 95.4 | — |
| 4 | 0.46 | 0.16 | 0.19 | 0.015 | 0.006 | 0.01 | 8.10 | — | — | 0.31 | — | — | 40 | — | 95.8 |
| 5 | 0.40 | 0.29 | 0.32 | 0.010 | 0.008 | 0.56 | 2.03 | 0.5 | — | 0.02 | — | 11.2 | — | 93.6 | — |
| 6 | 0.40 | 0.29 | 0.32 | 0.010 | 0.008 | 0.56 | 2.03 | 0.5 | — | 0.02 | — | — | 38 | — | 94.9 |

2. The raw powder for sintering according to claim 1, wherein the raw powder for sintering is manufactured by a prealloy method.

3. Granulated powder for sintering, obtained by granulating the raw powder for sintering according to claim 1 by means of a binder.

4. The granulated powder for sintering according to claim 3, wherein the mean grain size of the granulated powder for sintering is 10 to 150 μm.

5. A sintered compact with a relative density of 97% or greater, manufactured using the raw powder for sintering according to claim 1.

6. A sintered compact with a specific gravity of 97% or greater, manufactured using the granulated powder for sintering according to claim 3.

7. A method for manufacturing a sintered compact, comprising a molding a raw powder for sintering according to claim 1 and then sintering the molded raw powder.

8. A method for manufacturing a sintered compact, comprising a molding a raw powder for sintering according to claim 3 and then sintering the molded raw powder.

* * * * *